US006119639A

United States Patent [19]

Leijonberg

[11] Patent Number: 6,119,639

[45] Date of Patent: Sep. 19, 2000

[54] POWER MACHINE COOLING

[75] Inventor: Gunnar Leijonberg, Huskvarna, Sweden

[73] Assignee: Gul & Co. Development AB, Jonkoping, Sweden

[21] Appl. No.: 09/329,372

[22] Filed: Jun. 10, 1999

[30] Foreign Application Priority Data

Dec. 23, 1996 [SE] Sweden ..... 9604839-2

[51] Int. Cl.[7] ..... F02B 57/00

[52] U.S. Cl. ..... 123/44 B; 123/44 E; 123/41.47

[58] Field of Search ..... 123/41.47, 51 R, 123/51 A, 51 B, 41.72, 44 B, 44 A, 44 E

[56] References Cited

U.S. PATENT DOCUMENTS

| | | | |
|---|---|---|---|
| 2,320,928 | 6/1943 | Henson | 123/51 |
| 3,851,630 | 12/1974 | Foster | 123/44 R |
| 4,003,351 | 1/1977 | Gunther | 123/44 R |
| 4,030,471 | 6/1977 | Ginkel | 123/197 R |
| 4,334,506 | 6/1982 | Albert . | |
| 5,025,756 | 6/1991 | Nye | 123/18 R |
| 6,016,737 | 6/1943 | Leijonberg | 92/69 R |

FOREIGN PATENT DOCUMENTS

| | | |
|---|---|---|
| 1800103 | 3/1993 | U.S.S.R. . |
| 204220 | 9/1923 | United Kingdom . |

*Primary Examiner*—Willis R. Wolfe
*Assistant Examiner*—Katrina Harris
*Attorney, Agent, or Firm*—Pillsbury Madison & Sutro LLP

[57] ABSTRACT

The present invention is for cooling combustion engines of the kind in which two pistons are working against each other in a common cylinder bore and having a common combustion space. The invention is for a liquid cooling of such a power machine, preferably a combustion engine. Cooling channels are arranged in the housing (4). The pumpwheel (11) is mounted directly onto the outgoing shaft (9) and can be an integrated part thereof. The pump housing is integrated into the lower part of the cylinder housing (4).

1 Claim, 3 Drawing Sheets

POWER MACHINE COOLING

The present invention is for a device for cooling of power machines of the kind in which two pistons are working against each other in a common cylinder bore and with a common combustion space. The machines can be combustion engines, compressors or pumps. The linear movements of the pistons is transferred into rotating movement of an outgoing shaft from the machine.

From prior art designs there are known various kinds of combustion engines and other power machines such as pumps and compressors which have two pistons working against each other in a common cylinder bore or in axially coinciding, adjacent but separated cylinder bores. These designs allow a compact way of construction with small outer dimensions. The arrangement for transferring the to and fro motion into a rotating motion is in some designs very spacious and limits the possibilities to supply for example cooling medium.

One embodiment where the to and fro motion is transferred into rotating motion by means of a ball bearing which runs in several tracks is described in the Swedish patent application No. 9601282-8. This device includes a rotating disc, at or on which there is a rotating track having for example elliptic or clover shape. The present invention is for a device for liquid cooling of such a power machine, preferably a combustion engine.

The invention will below be described more in detail with reference to the enclosed figures.

Figure 1:
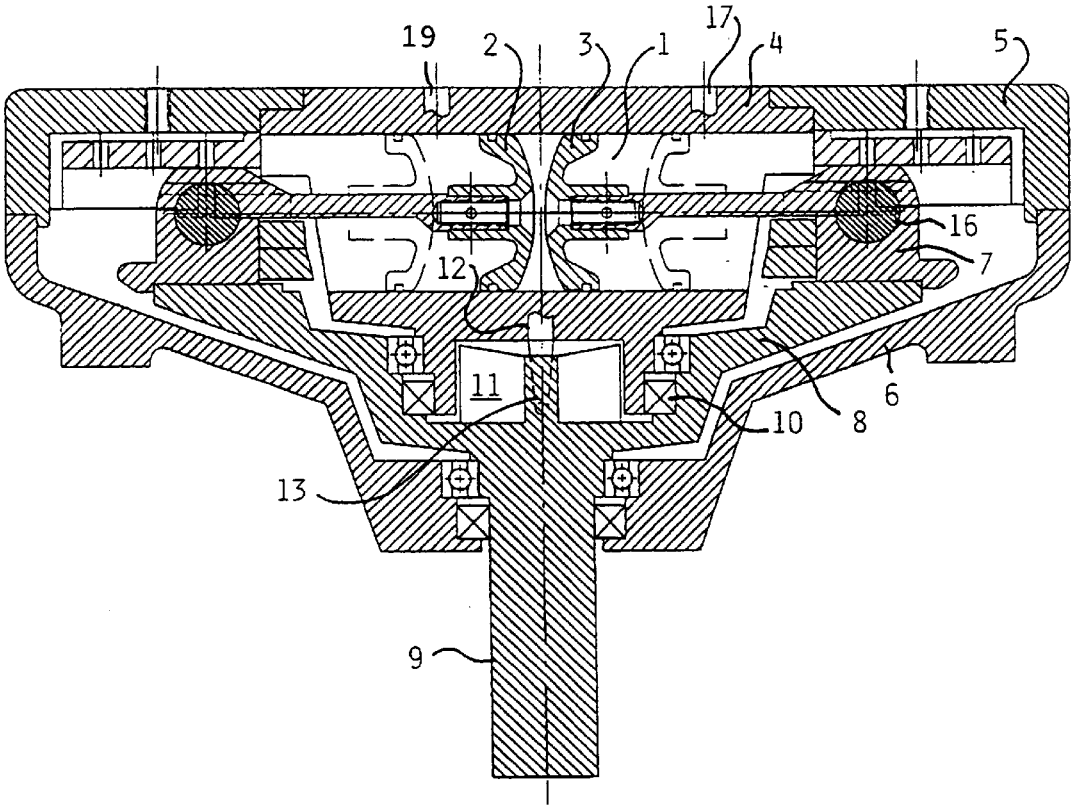
FIG. 1 is a cross-section in the lengthwise direction of the cylinder bore of a combustion engine having a device according to the invention.
Figure 2:
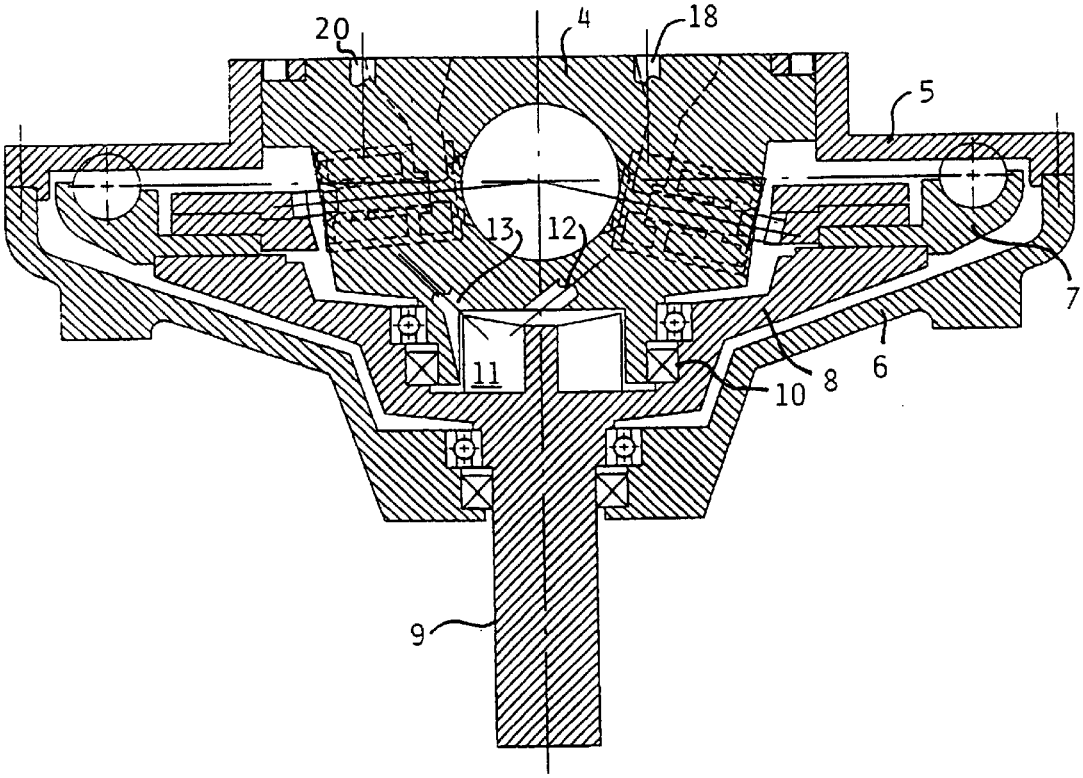
FIG. 2 shows a cross-section of the combustion engine of FIG. 1 at right angle to the lengthwise direction of the cylinder bore.
Figure 3:
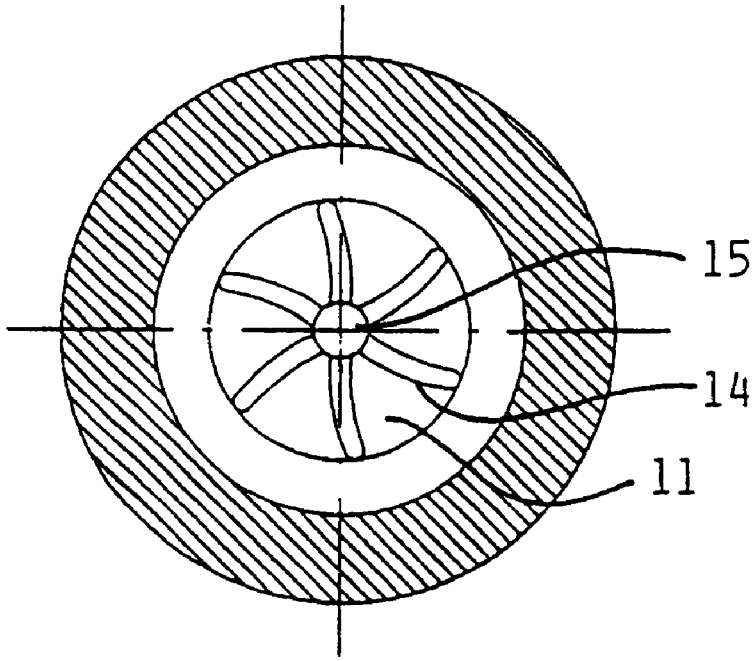
FIG. 3 shows in partial cross-section the impeller of the cooling means of FIGS. 1 and 2.

The device is included in a power machine, preferably a combustion engine. This comprises a cylinder bore 1 which is common for two pistons 2, 3. Between these pistons there is a common compression and combustion space. The cylinder bore is surrounded by a housing 4 having a permanently mounted lid 5 and a bowl 6. The housing and the bowl have a mainly circular outer shape. The power is transferred between the outgoing shaft 9 and the pistons through a rotating disc 8 which preferably is circular and which at its outer part 7 is arranged for transmission of force. This can take place thereby that the pistons have fixedly mounted backwardly extending piston rods each of which has a ball

16 which runs in a linear track in the lid 5 and in an elliptic or otherwise as a closed curve shaped track in the outer part 7 of the rotating disc 8.

Cooling channels are arranged in the housing 4 and apparent from the figures are parts of the inlet and outlet openings for these channels both at the upper side of the housing and adjacent to the pumping wheel 11. In the embodiment shown in the figures the inlet openings 17, 18 and outlet openings 19, 20 are then arranged at the upper side of the housing. In the housing of the pump there is at least one inlet opening 12 and one outlet opening 13. The path of the cooling channels in the housing 4 is adapted to the application and is not shown in the figures.

The impeller 11 is mounted directly on to the outgoing shaft 9 and in a preferred embodiment of the invention it can be an integrated part of the shaft. The housing of the pump is an integrated part of the lower part of the cylinder housing 4 and the pump for the cooling means then requires no special arrangements for propelling and pumping. It is also achieved that the flow which is caused by the pump will be directly dependent upon the speed of rotation of the rotating part 8 and thus gives an increasing flow when the need for cooling increases. The rotating part is sealed against the stationary part 4 by means of a seal 10 and nor in this respect any specific means for sealing of the pump is required.

In order to vary the flow of cooling medium in relation to the temperature and the need of cooling the impeller may be disconnected from the driving function of the outgoing shaft by being connected thereto by a clutch means which is for example thermally controlled. This means can be a friction clutch or an induction clutch.

What is claimed is:

1. Device for liquid cooling of a power machine preferably a combustion engine having a cylinder bore which is common for two against each other working pistons and which is surrounded by a housing (4), in which there are channels for the cooling liquid, a lid (5) and a bowl (6) mounted on to the housing and means for transferring the to and fro motion of the pistons into rotating motion by means of a rotating disc between the bowl (6) and the lid (5)/housing (4), the disc being permanently mounted to an outgoing shaft (9) characterised therein that it comprises a pump for cooling means, the pump housing of which is a part of the housing (4) and a pumpwheel (11) situated therein being an integrated part of or mounted on to the outgoing shaft (9).

* * * * *

UNITED STATES PATENT AND TRADEMARK OFFICE

CERTIFICATE OF CORRECTION

PATENT NO. : 6,119,639
DATED : September 19, 2000
INVENTOR(S) : Leijonberg

It is certified that error appears in the above-identified patent and that said Letters Patent is hereby corrected as shown below:

Title page,
Add:

-- [63] Related U.S. Application Data
Continuation of international application No. PCT/SE97/02145, Dec. 18, 1997 --.

Signed and Sealed this

Fifth Day of March, 2002

*Attest:*

*Attesting Officer*

JAMES E. ROGAN
*Director of the United States Patent and Trademark Office*